US006470546B1

(12) United States Patent
Bonny et al.

(10) Patent No.: US 6,470,546 B1
(45) Date of Patent: Oct. 29, 2002

(54) PROCESS AND APPARATUS FOR PRODUCING A LINKAGE OF AN AIR/FUEL RATIO DETECTOR HOLDER TO AN EXHAUST PIPE

(75) Inventors: Pierre Bonny, Hamburg; Thomas Huelsberg, Rosengarten, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/594,706

(22) Filed: Jun. 16, 2000

Related U.S. Application Data

(63) Continuation of application No. 09/127,916, filed on Aug. 3, 1998, now Pat. No. 6,092,285.

(30) Foreign Application Priority Data

Aug. 2, 1997 (DE) ..... 197 33 473

(51) Int. Cl.[7] ..... B23P 25/00

(52) U.S. Cl. ..... 29/33 T; 29/727; 29/890.053; 72/370.27

(58) Field of Search ..... 29/890.053, 890.044, 29/890.052, 897.2, 33 T, 897, 557, 421.1, 727; 72/58, 55, 370.27

(56) References Cited

U.S. PATENT DOCUMENTS

| | | | | |
|---|---|---|---|---|
| 3,209,575 A | * | 10/1965 | Woodward, Jr. et al. | 72/327 |
| 4,582,259 A | * | 4/1986 | Hoover et al. | 72/370.27 |
| 4,798,076 A | * | 1/1989 | Rigsby et al. | 72/370.27 |
| 4,989,482 A | * | 2/1991 | Mason | 72/55 |
| 5,996,455 A | * | 12/1999 | Haag et al. | 72/55 |

* cited by examiner

*Primary Examiner*—S. Thomas Hughes
*Assistant Examiner*—T. Nguyen
(74) *Attorney, Agent, or Firm*—Crowell & Moring LLP

(57) ABSTRACT

A process and a device produces a linkage of a hollow cylindrical air/fuel ratio detector holder to an opening for the impingement of the air/fuel ratio detector, which is fastened into the holder, to an exhaust pipe equipped with exhaust gas. A desired finished shape is given through internal high-pressure remodeling of a blank pipe. During this process, internal high-pressure remodeling creates a contact surface on the exhaust pipe which is formed by a buckling. The contact surface is created to in the inverted shape of the contact contour of the casing surface of the holder so that a dimensionally stable linkage of an air/fuel ratio detector holder to an exhaust pipe is achieved simply.

5 Claims, 4 Drawing Sheets

PROCESS AND APPARATUS FOR PRODUCING A LINKAGE OF AN AIR/FUEL RATIO DETECTOR HOLDER TO AN EXHAUST PIPE

This application is a continuation of application Ser. No. 09/127,916, filed Aug. 3, 1998 now U.S. Pat. No. 6,092,285.

BACKGROUND OF THE INVENTION

This application claims the priority of German application 197 33 473.3, filed Aug. 2, 1997 in Germany, the disclosure of which is expressly incorporated by reference herein.

The present invention concerns a process for producing a linkage or connection between a hollow cylindrical air/fuel ratio detector holder and an exhaust pipe which acquires a desired finished shape through internal high-pressure forming or "remodeling" of a blank piece, and a device or apparatus for carrying out the process.

Air/fuel ratio detector holders are known in manifold types, as shown for example, in DE 34 09 045 C1. In all of these known configurations, the holder is fitted specifically to the curved shape of the exhaust pipe in order to attain a dimensionally stable link between the holder and the exhaust pipe. This guarantees that a subsequent welding of the holder to the exhaust pipe creates a connection which withstands mechanical and thermal stress. The specific fitting process is, however, expensive in terms of production technology and is thus cost-intensive. In particular, in tight component space conditions, in which the hollow cylindrical holder is forced to be fastened with its casing to the exhaust pipe, this can be accomplished accurately only either through a highly complicated contour milling of the casing of the holder, or through forming the holder as a precision cast part whose contour structure is shaped during the casting procedure. Both methods demand expensive tools and involve long processing times. This also causes increased costs in the shaping of an appropriate link between the holder and the exhaust pipe.

SUMMARY OF THE INVENTION

An object of the present invention is to provide a process or respectively a device with which a dimensionally stable link or connection is attained between an air/fuel ratio detector holder and an exhaust pipe, in a simple manner and by saving space for the components.

This object has been achieved in accordance with the present invention by a process in which a contact surface formed by a buckling portion of the exhaust pipe has an inverted shape of the contact contour of the holder casing surface. A device for effecting this process includes a tool with an upper and lower die for "remodeling" or forming an inserted blank pipe into the desired shape of the exhaust pipe. The remodeling tool integrated shaping apparatus has a contour facing the blank pipe and corresponds to the contact contour of the holder casing surface.

The present invention is based on the recognition that it is advantageous to use an internal high-pressure technique for the shaping of the link to shape exhaust pipes with essentially tolerance-free complicated curvatures as exhaust pipes or their parts are so manufactured increasingly in recent times. With this, in a simple manner, the exhaust pipe is shaped with internal high pressure at the point where the future contact surface of the holder is planned to be, true to form with regard to the contact contour of the casing of the holder in inverted shape. The link of the holder with its casing to the exhaust pipe saves space for components, as the holder has at this point a certain circumference sunk, so to speak, into the exhaust pipe, or at least however flush with the pipe side. This takes place in the production in only one operation, jointly with the remodeling or forming of the blank pipe into the desired finished shape of the exhaust pipe.

An added benefit of the process of the present invention is that the shaping of this link can be exactly reproduced over many forming or remodeling operations. In addition, this approach eliminates both the need for developing expensive special parts, such as the in the aforementioned precision-cast part, and costly special production processes, which are suitable for fitting the holder to the exhaust pipe in the contact contour.

Now, with the present invention, only a simple and cost advantageous frame or body is needed as holder, which in addition to the internal thread for the accommodation of the screw of the air/fuel ratio detector need have only a transverse bore which corresponds to the opening in the exhaust pipe configured to provide access for the exhaust stream to the air/fuel ratio detector. In addition, the joint or shared use of the same tools appears advantageous in terms of cost savings and expenditure of space. The shaping apparatus can be installed permanently in a matrix or body of the remodeling tool or integrated into a substitutable body which can be introduced into the remodeling tool whenever required.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
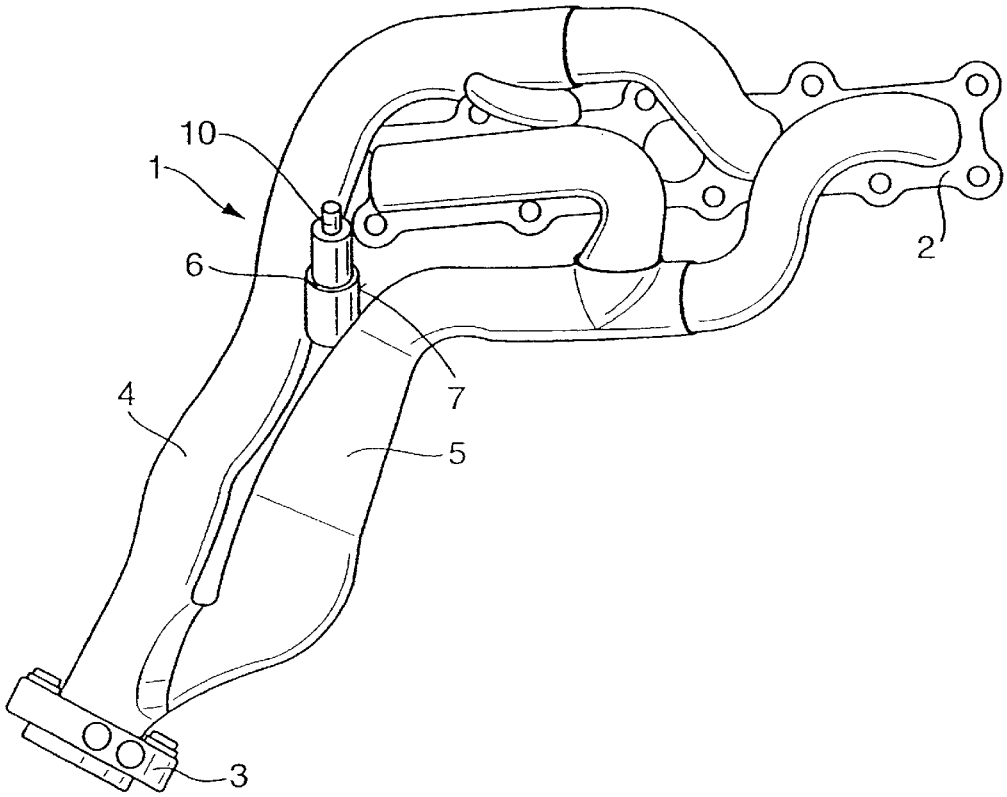
FIG. 1 is a perspective view of an exhaust pipe with an air/fuel ratio detector holder linked or connected to two exhaust pipes in accordance with the present invention.
Figure 2:
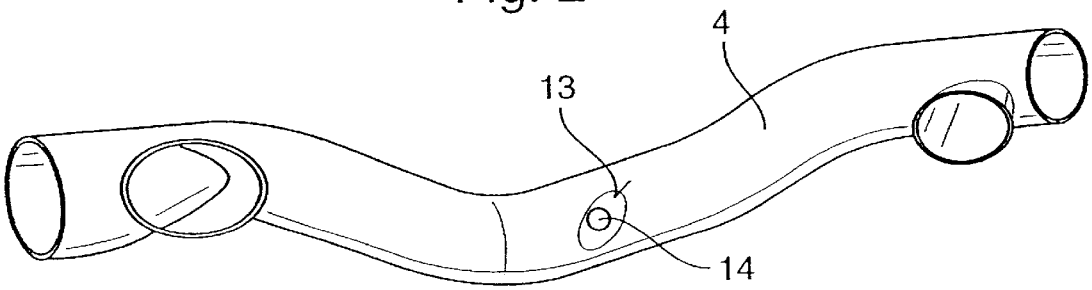
FIG. 2 is a perspective view of the exhaust pipe of FIG. 1 with the configured contact surface for an air/fuel ratio detector holder.

In FIG. 1 an exhaust system 1 is shown which, on one hand, connects to an input flange 2 with which the system 1 is fastened to a cylinder head of the internal combustion engine and, on the other hand, is connected to an output flange 3, to which, in the exhaust flow direction, further exhaust pipes are connected, for example a catalytic converter directly downstream. The exhaust system is made up principally of two separate exhaust pipes 4, 5 which merge in the area of the output flange 3. Upstream from this area of merger, between the pipes 4, 5, a hollow cylindrical, tube-shaped air/fuel ratio detector holder 6 is welded with areas of its casing surface to both pipes 4, 5.

Figure 3:
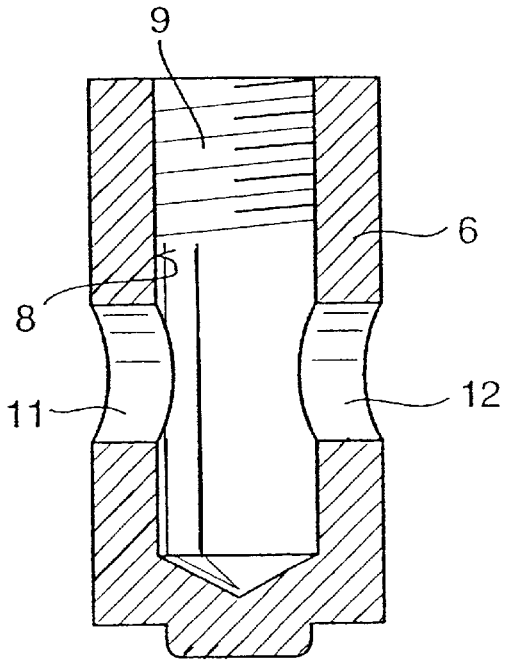
FIG. 3 is a cross-sectional elevational view of the air/fuel ratio detector holder of FIG. 1.

The detector holder 6 is molded or formed into a body (FIG. 3) and has a central bore 8 with an internal thread 9 into which the air/fuel ratio detector is screwed. The detector holder additionally has two transverse bores 11, 12, which intersect the central bore 8 and also, depending on the positioning of the pipes 4, 5 and the detector holder 6 to each other, can be configured as a single through bore. The transverse bores 11, 12, or alternatively the through-bore serve as a connection for the measurement antenna or sensor of the air/fuel ratio detector 10 so that it can be reached by exhaust gas in the pipes 4, 5.

The pipes 4, 5 are shaped dimensionally stable by internal high pressure and calibrated. In place of both pipes 4, 5, the of contact with the detector holder 6, which is developed with the internal high-pressure in the inverted shape of the casing surface 7 of the detector holder 6 at the contact contour. In the buckling portion 13, the exhaust pipe 4 has an opening 14, to which the transverse bore 11 is connected and through which exhaust gas from the exhaust pipe 4 can reach the detector.

The following describes in combination with the used tools the production of the link consisting of the buckling portion 13 and the opening 14 reference to FIGS. 4–8.

A blank pipe 15 is placed into the internal high-pressure remodeling tool 16, which is divided into an upper die 17 and a lower die 18. An engraving or die face is made by the upper die 17 and the lower die 18 through corresponding notches in the opposed faces 19, 20, between which the blank pipe 15 loosely rests. In the dividing plane 22 of the two parts 17, 18 of the tool lies a guide bore 23 which leads into the engraving or die face 21 and in which a stamping die 24 is adjustably guided.

Figure 4:
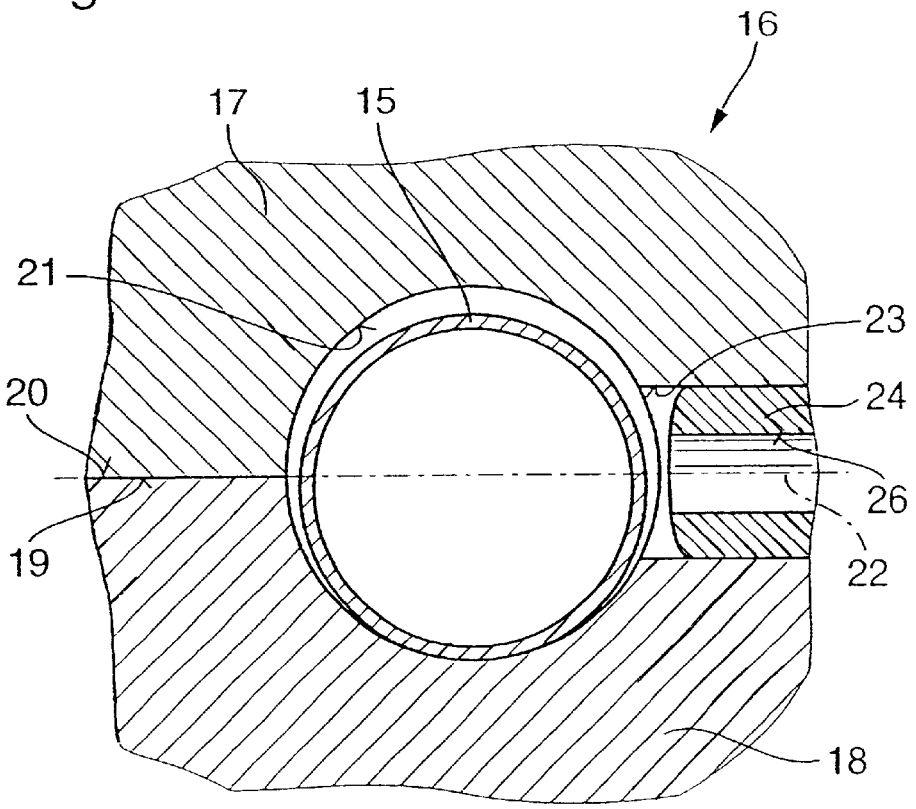
FIG. 4 is a cross-sectional view of a blank pipe in an internal high-pressure remodeling tool with an integrated stamping die.

Pointing to the blank pipe 15, the face 25 of the stamping die 24, which can be plunged or moved into the engraving o die face 21, is shaped in its contour, at least where the buckling portion's 13 contact surface for the detector holder 6 is located, corresponding to the contact contour of the casing surface 7 of the detector holder 6. In FIG. 4, the stamping die is still located in a position withdrawn from the engraving or die face 21, while the remodeling tool 16 and the blank pipe 15 are in a pressure-neutral condition with regard to fluid pressure.

Figure 5:
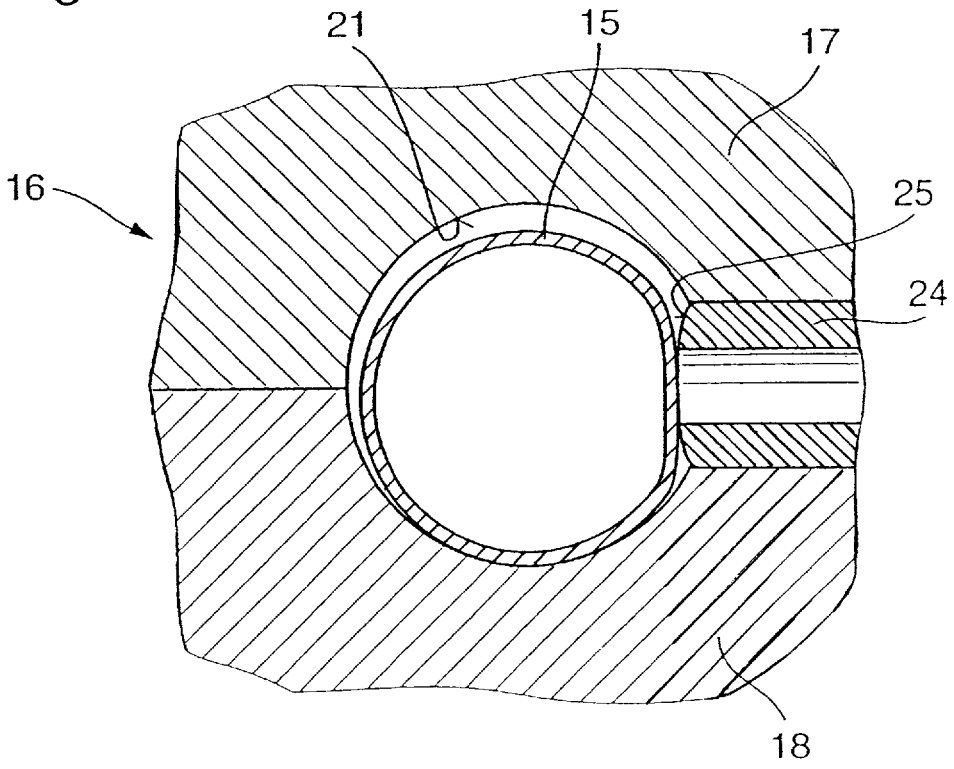
FIG. 5 is a cross-sectional view of the blank pipe of FIG. 4 under impingement of the stamping die in pressure-neutral condition of the internal high-pressure remodeling tool.
Figure 6:
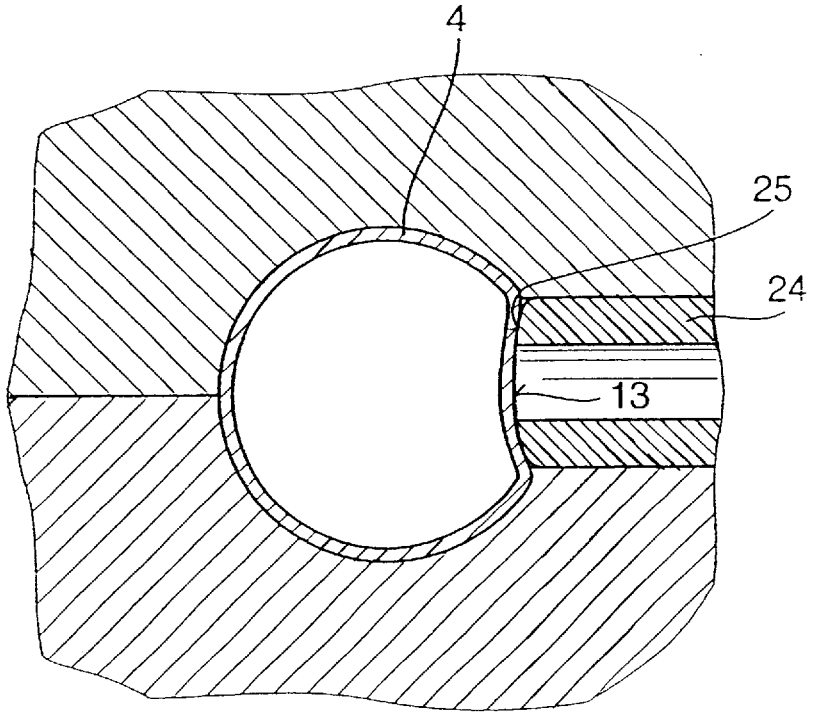
FIG. 6 is a cross-sectional view of the blank pipe of FIG. 4 under impingement of the stamping die, with internal high pressure prevailing in the internal high-pressure remodeling tool.

According to FIG. 5, the stamping die 24 is now pushed, preferably hydraulically, into the engraving or die face 21, whereby the blank pipe 15 is indented on an impingement surface. This can be done both with and without prior pressurizing of the blank pipe 15 with pressure fluid, if necessary by creating a moderate internal high pressure, which resides below the remodeling pressure. With pressurization the danger of buckling of the blank pipe 15 is avoided; however, for the indenting high pressure forces are required. Without pressurization the danger of buckling exists; however this buckling can be avoided through a suitable layout of the stamping diameter and the thickness of the pipe sides. In any event, the indenting can be accomplished in a simple manner. The stamping die 24 remains at first in this indenting position. If not done so earlier, now the blank pipe 15 is pressurized with a fluid.

to Thereafter, as shown in FIG. 6, internal high pressure is increased to widen and press the blank pipe 15 to the contour of the stamping die 24. After fitting the blank's side to the engraving 21 of the remodeling tool 16, a calibrator pressure is created which is higher than the previous widening pressure. Therewith, the exhaust pipe 4, 5, which is now in its finished dimensionally stable shape, is molded to the engraving or die face 21 on all sides, and the buckling portion 13 which has resulted from the indenting is developed. Because of the calibrating pressure, the adjacent areas of the blank pipe 15, which were inadvertently affected by the indenting, are leveled out by the contact with the die or engraving face 21. Of course, the shaping of the buckling portion 13, including indenting, can be carried out during the widening of the blank pipe 15 to reduce the time needed for the completion of the process. However, this requires high hydraulic forces for the stamping die 24 both during the indenting and the shaping of the buckling portion 13. Additionally, the blank pipe 15 can be formed or remodeled into the finished shape of the exhaust pipe 4, 5 first, and then the buckling portion 13 can be shaped in a subsequent remodeling phase. This brings with it, however, the disadvantage of a longer process time, but also reduces the required force for the stamping die 24, because the pressure conditions within the finished exhaust pipe 4, 5 can be adjusted specifically to the shaping of the buckling portion 13.

As an alternative to the stamping die 24, the exhaust pipe 4, 5 or the blank pipe 15 can be pressed by internal high pressure against an engraving or die face 21 of an internal high-pressure remodeling or forming tool 16, which has a shape corresponding to the contour of the detector holder 6 at the point of the to-be-created buckling portion 13. In this embodiment, because of the elimination of the stamping die 24, the number of parts needed in the production process is reduced and the control for it, on the whole, simplified. However, only blank pipes 15 or respectively exhaust pipes 4, 5 can be used whose diameter is smaller than the diameter of the engraving or die face 21 at the point of their inward standing contour bulge. In one alternative, this approach excludes the introduction of a finished "remodeled" or formed exhaust pipe 4, 5 for the shaping of the buckling portion, as this goes hand in hand with a simultaneous widening of the exhaust pipe, which would change its shape in an undesirable manner. On the other hand, after introducing a blank pipe 15, during the widening until contact is made with the engraving or die face 21 relatively high degrees of forming or remodeling are required. This may lead to the failure of the blanks and with it to an increased number of defective rejects among the produced exhaust pipes 4, 5.

Figure 7:
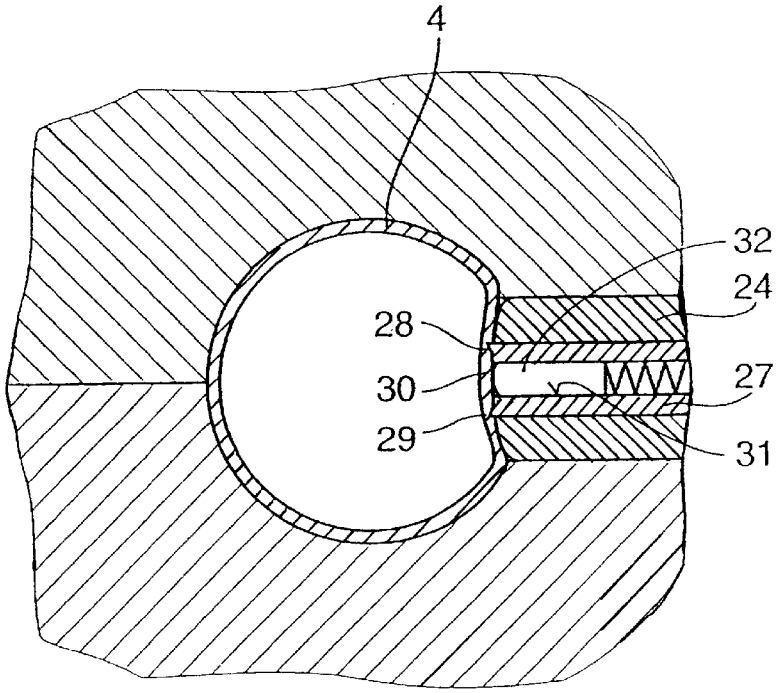
FIG. 7 is a cross-sectional view of the blank pipe of FIG. 4 under impingement of the stamping die and a punching die, with the internal high pressure prevailing in the internal high-pressure remodeling tool.

As will be readily understood from FIG. 7, the stamping die 24 continues to remain in its indenting position. The stamping die 24 is drilled hollow and slidably accommodates or accepts in it its bore 26 an adjustably guided punching die 27. The punching die has a circular notch 28 with which it is driven into the side material of the exhaust pipe 4, 5 upon impinging. Thereby the penetration depth is measured in such a way that only a small circular thin spot 29 remains in the pipe's side. Thereafter the punching die 27 retracts, whereupon the internal high pressure tears the pipe's side cleanly around the thin spot 29, resulting in the creation of the opening 14 in the exhaust pipe 4, 5 and in a hole bow 30 from the side material. The punching die 27 is retracted only so far that the hole bow 30 does not leave the opening 14. A fall off of the pressure takes place in the remodeled exhaust pipe 4, 5 as a result of this tear. Because of the integration of the punching die 27 into the stamping die 24, on one hand, space is saved in the remodeling or forming tool 16 space for components and, on the other hand, an opening 14 positioned within the buckling portion 13 is created, which can be reproduced exactly at any time and without expenditure. In the above mentioned alternatives, based on the specific shaping of the engraving or die face 21, an execution can be arranged, in which a stamping die is guided which receives a punching die.

Figure 8:
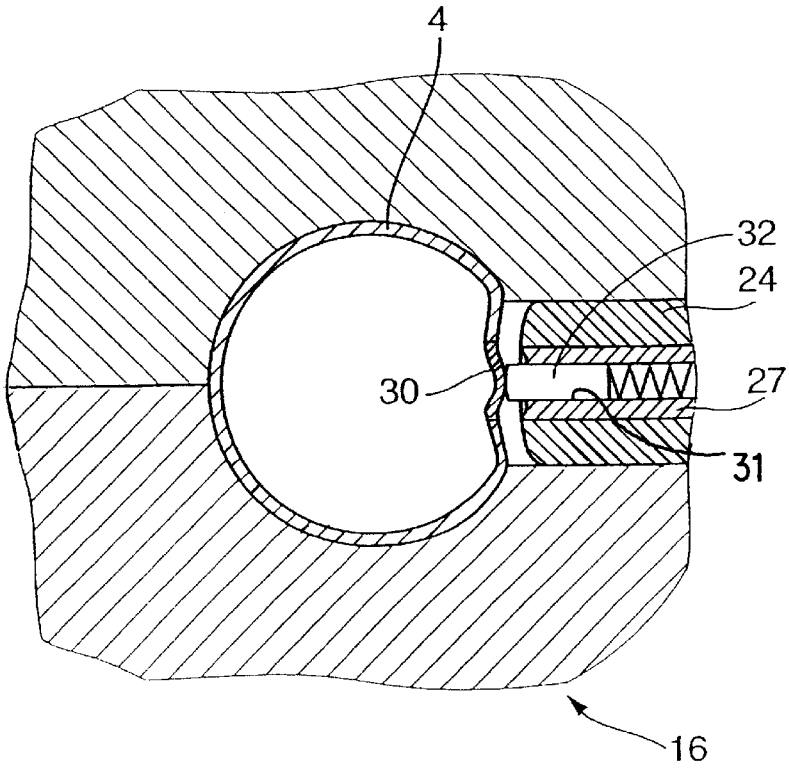
FIG. 8 is a cross-sectional view the blank pipe of FIG. 4 in low-pressure condition of the internal high-pressure remodeling tool with re-transferred stamping and punch die during the jamming of the bow of the hole by way of a plunger.

According to FIG. 8, the central portion of the punching die has a guiding bore 31 in which a plunger 32 is adjustably or slidably guided. The plunger 32 is spring-loaded and pre-stressed during the stamping against the exhaust pipe 4, 5. After the pressure drop in the exhaust pipe 4, 5, an internal fluid pressure prevails, climbing below the remodeling or forming pressure, in which a complete release pressure can be achievable. In addition, the fluid can be directed out of the exhaust pipe 4, 5. In all mentioned cases, the spring-loaded plunger 32 impinges on the hole bow 30 which is jammed into the opening 14 without jutting out. The stamping die 24 is retracted jointly with the punching die, whereby both come off the exhaust pipe. After the opening of the remodeling or forming tool 16, the remodeled and hole-punched exhaust pipe 4, 5 is taken out, after which the hole bow 30 is pushed out by a pin. Thereby, the opening 14 in the exhaust pipe 4, 5 is opened up. In a final process step, the holder 6 is finally placed into the buckling portion 13 on the exhaust pipe 4, 5 and welded thereto.

It should be understood that the contact surface can be shaped for hollow profiles of any kind, as for example in the intake system of an internal combustion. engine or with hollow frame parts of car bodies or axle support or respectively steering.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus for producing a linkage between an exhaust pipe and a hollow cylindrical air/fuel ratio detector holder with an opening for receiving an air/fuel ratio detector in the holder, comprising means for providing a desired finished shape of the exhaust pipe through internal high-pressure on a buckling portion of the exhaust pipe so as to have an inverted contact contour shape complimentary to a convex casing surface of the detector holder, said means including:

an internal high-pressure tool divided into an upper die and a lower die for forming a surface by inserting a blank pipe into the desired finished shape of the exhaust pipe, and a shaping device integrated into the tool with a contour facing the pipe corresponding to a contact contour of the casing surface of the holder at a location of intended contact surface at the exhaust pipe.

2. Apparatus according to claim 1, wherein the shaping device is constituted by a buckling portion of the surface of the tool.

3. Apparatus according to claim 1, wherein the shaping device is formed by a stamping die which is adjustably guidable in a guide bore arranged in the tool and leads into the surface, whereby the contour of the stamping die, having a face movable into the engraving, is shaped correspondingly to the contact contour of the casing surface of the holder.

4. Apparatus according to claim 1, wherein a punching die is integrated into the remodeling tool for producing the opening in the finished exhaust pipe.

5. Apparatus according to claim 4, wherein the shaping device has a bore within which its punching die is adjustably held.

* * * * *